US008388374B2

(12) United States Patent
Grek et al.

(10) Patent No.: US 8,388,374 B2
(45) Date of Patent: Mar. 5, 2013

(54) COUPLING SYSTEM FOR ELECTRICAL CONNECTOR ASSEMBLY

(75) Inventors: Joachim I. Grek, Katrineholm (SE); Owen R. Barthelmes, Putnam Valley, NY (US); Michael A. Hoyack, Sandy Hook, CT (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 13/085,058

(22) Filed: Apr. 12, 2011

(65) Prior Publication Data

US 2012/0264322 A1 Oct. 18, 2012

(51) Int. Cl.
*H01R 9/09* (2006.01)

(52) U.S. Cl. ..... 439/578

(58) Field of Classification Search ..... 439/578–585
See application file for complete search history.

(56) References Cited

U.S. PATENT DOCUMENTS 3,747,048 A 7/1973 Johnson et al.
4,296,986 A 10/1981 Herrmann, Jr.
4,405,196 A 9/1983 Fulton
4,553,807 A 11/1985 Cane
5,662,489 A 9/1997 Stirling
5,713,765 A 2/1998 Nugent
5,816,835 A 10/1998 Meszaros
6,176,716 B1 1/2001 Mercurio et al.

*Primary Examiner* — Gary F. Paumen
(74) *Attorney, Agent, or Firm* — Blank Rome LLP

(57) ABSTRACT

An electrical connector assembly that comprises a first connector member including a first connector body supporting a first contact. The first connector body is formed of a substantially rigid material and has a first interface end. The first interface end has a substantially conical shape that defines a first tapered surface. A second connector member includes a second connector body supporting a second contact configured to mate with the first contact. The second connector body is formed of a substantially rigid material and has a second interface end that mates with the first interface end. The second interface end of the second connector member has a second tapered surface. The first and second tapered surfaces have substantially the same angle of taper and taper in opposite directions to engage one another in a friction fit wherein the angle of taper is between about 3.5° to 6.5°. A coupling member is mounted near one of the first and second interface ends and has an internal engagement member that is configured to engage a corresponding external engagement member of the other of the first and second connector bodies.

16 Claims, 4 Drawing Sheets

COUPLING SYSTEM FOR ELECTRICAL CONNECTOR ASSEMBLY

FIELD OF THE INVENTION

The present invention relates to a coupling system for an electrical connector assembly. More specifically, the coupling system includes both inner and outer engagements that provide a secure connection between the components of the connector assembly to prevent loosening thereof due to movement or vibration of the components.

BACKGROUND OF THE INVENTION

The interconnection between components of an electrical connector assembly, such as a plug and receptacle, is critical to maintaining the proper electrical connection therebetween. Often conventional electrical connector assemblies loosen, particularly when subjected to vibration. Such loosening compromises the integrity of the electrical connection between the components.

Examples of conventional electrical connector assemblies are found in U.S. Pat. Nos. 4,556,807 to Cane, 4,296,986 to Herrmann, Jr., and 4,405,196 to Fulton, the subject matter of each of which is herein incorporated by reference.

SUMMARY OF THE INVENTION

Accordingly, the present invention provides an electrical connector assembly that comprises a first connector member including a first connector body supporting a first contact. The first connector body is formed of a substantially rigid material and has a first interface end. The first interface end has a substantially conical shape that defines a first tapered surface. A second connector member includes a second connector body supporting a second contact configured to mate with the first contact. The second connector body is formed of a substantially rigid material and has a second interface end that mates with the first interface end. The second interface end of the second connector member has a second tapered surface. The first and second tapered surfaces have substantially the same angle of taper and taper in opposite directions to engage one another in a friction fit wherein the angle of taper is between about 3.5° to 6.5°. The friction fit forms an inner engagement between the first and second connector members. A coupling member is mounted near one of the first and second interface ends of the first and second connector bodies, respectively. The coupling member has an internal engagement member that is configured to engage a corresponding external engagement member of the other of the first and second connector bodies to form an outer engagement between the first connector member and said second connector member.

The present invention also provides an electrical connector assembly that comprises a plug member including a plug body supporting a male contact. The plug body is formed of a substantially rigid conductive material. The plug body has an interface end and a cable termination end opposite the interface end. The interface end of the plug body has a substantially conical shape that defines a first tapered surface which tapers inwardly toward a central longitudinal axis of the plug body. A receptacle member includes a receptacle body that supports a female contact configured to receive the male contact of the plug member. The receptacle body is formed of a substantially rigid conductive material. The receptacle body has an interface end that mates with the interface end of the plug member and an equipment end opposite the interface end. The interface end of the receptacle body includes external threads. The interface end of the receptacle member has a second tapered surface. The second tapered surface tapers outwardly away from a central longitudinal axis of the receptacle body. The first and second tapered surfaces have substantially the same angle of taper and engage one another to form an inner friction fit engagement between the plug member and the receptacle member wherein the angle of taper is between about 3.5° to 6.5°. A nut member is rotatably mounted to the plug member near the interface end of the plug body. The nut member has internal threads that are configured to engage the external threads of the receptacle body to form an outer threaded engagement between the plug member and the receptacle member.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
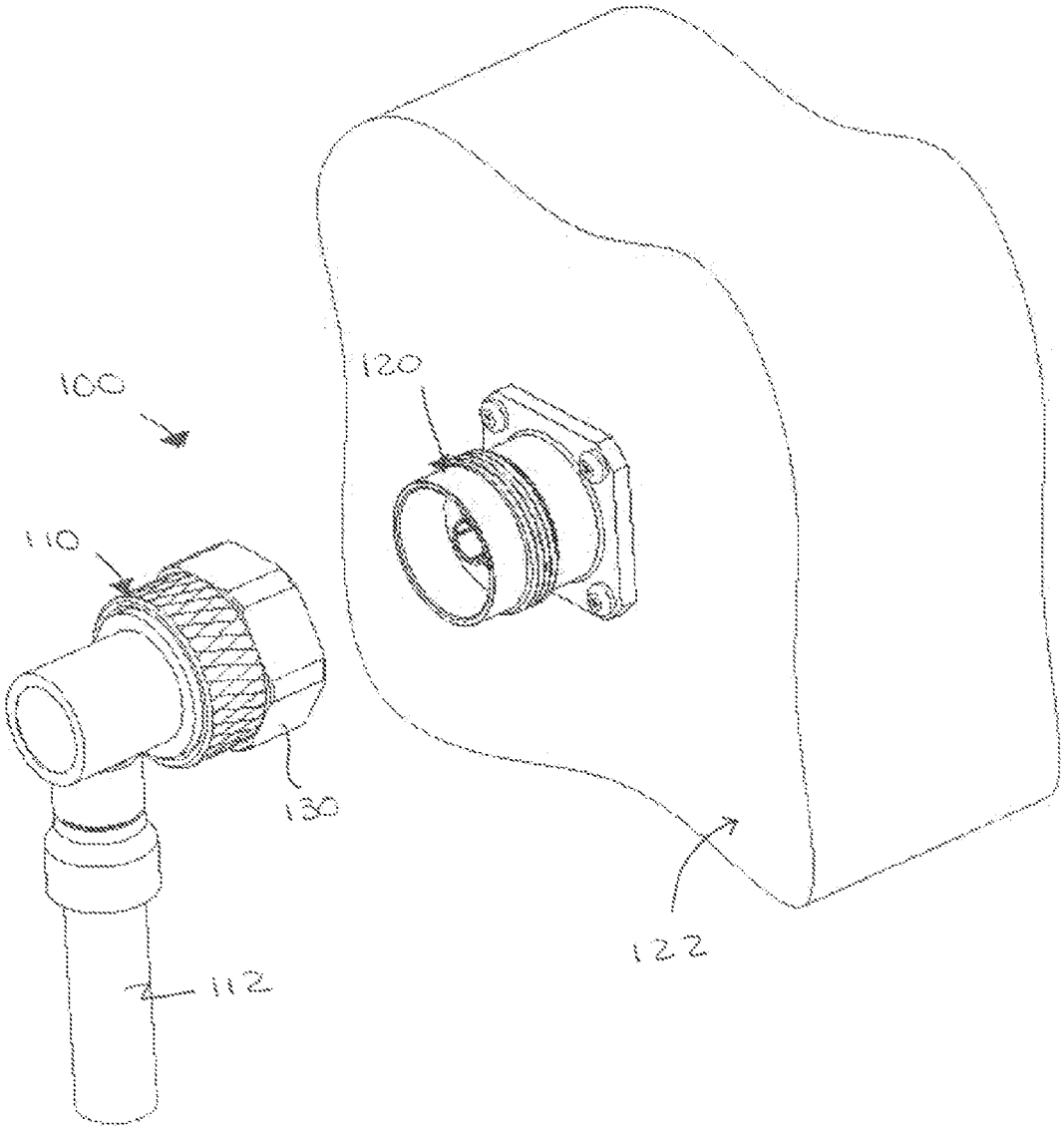
FIG. 1 is an exploded perspective view of an electrical connector assembly according to an exemplary embodiment of the present invention, showing the components of the connector assembly connected to a cable and equipment panel, respectively.

Referring to FIGS. 1-3, 4A and 4B, the present invention generally relates to an electrical connector assembly 100 that includes a coupling system for securely mating the components of the connector assembly even during movement, such as vibration. In general, the coupling system includes both an inner engagement and an outer engagement between the connector assembly components to positively secure the connector components both mechanically and electrically.

The components of the electrical connector assembly 100 generally include first and second connector members 110 and 120, such as a plug and mating receptacle. The plug member 110 preferably connects to and terminates a cable 112, such as a coaxial cable, in a manner well known in the art. The receptacle member 120 preferably connects to an equipment panel 122, such as equipment used in wireless base station applications, e.g. transceivers, filters, amplifiers, antennas and the like.

The plug member 110 may include a plug body 202 that internally supports a contact 204, such as a male contact or pin. The pin 204 is particularly supported by an insulator 206.

Figure 2:
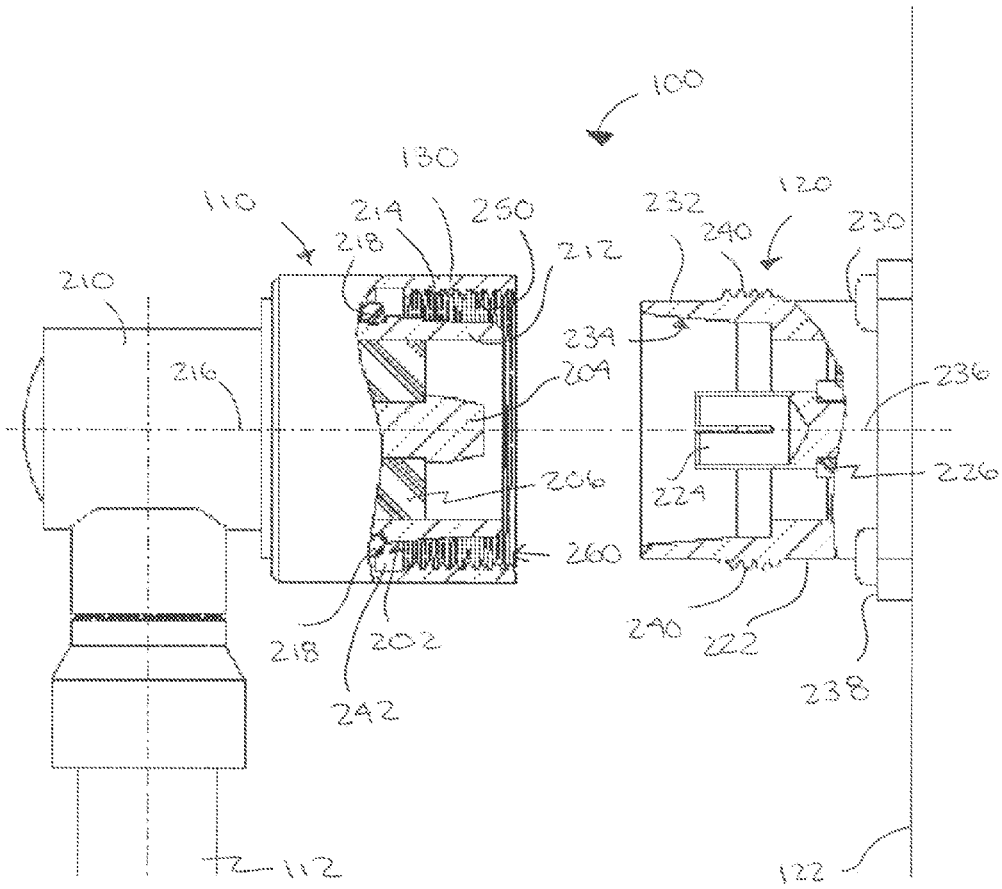
FIG. 2 is an exploded elevational view in partial section of the electrical connector assembly illustrated in FIG. 1, showing the components of the connector assembly in the disassembled state.

The plug member 110 includes one end 210 that terminates the cable 112 and an interface end 212, opposite the end 210 that interfaces with the receptacle member 120. As best seen in FIG. 2, the interface end 212 has a substantially conical shape that defines an outer tapered surface 214. The outer tapered surface 214 slopes inwardly toward a central longitudinal axis 216 of the plug body 202 and to the distal end of the plug body interface end 212 (e.g. shown tapering inwardly from left-to-right in FIG. 2).

The outer surface of the plug body 202 may also include an annular groove that is preferably positioned adjacent the outer tapered surface 214 that receives a sealing groove 218. The plug body 110 is preferably formed of a substantially rigid material that may be conductive, such as metals like brass aluminum or zinc alloys as well as metalized plastic.

The receptacle member 120 may include a receptacle body 222 that internally supports a contact 224, such as a female contact or socket. The socket 224 is particularly supported by an insulator 226 and is adapted to receive the pin 204 of the plug member 110. The receptacle body 222 includes one end 230 that connects to the equipment panel 122. Opposite end 230 is an interface end 232 configured to couple with the interface end 212 of the plug member 110. The interface end 232 of the receptacle body 222 has an inner tapered surface 234 that corresponds to the outer tapered surface 214 of the plug body 202 to form a friction fit therebetween when the plug and receptacle members 110 and 120 are assembled. The inner tapered surface 234 slopes outwardly away from a central longitudinal axis 236 of the receptacle body 222 and to the distal end of the receptacle body interface end 232 (e.g. shown tapering outwardly from right-to-left in FIG. 2).

The receptacle body 222 includes an engagement member 240 on its outer surface. The engagement member 240 is preferably a plurality of threads at or near the interface end 232 of the receptacle body 222. The receptacle body 222 is mounted to the equipment panel 122 at its end 230 by a mounting flange 238. Like the plug body, the receptacle body 222 is preferably formed of a substantially rigid material that may be conductive.

As seen in FIG. 1, a coupling member 130 externally engages the plug and receptacle members 110 and 120. The coupling member 130 is preferably rotatably mounted to the plug body 110 by a ring clip 242. The coupling member 130 may include an engagement member 250 that corresponds to and engages the engagement member 240 of the receptacle body 222. The coupling member 130 is preferably a nut wherein the engagement member 250 is a plurality of threads disposed on its inner surface that engage the plurality of threads 240 on the outer surface of the receptacle body 222.

Figure 3:
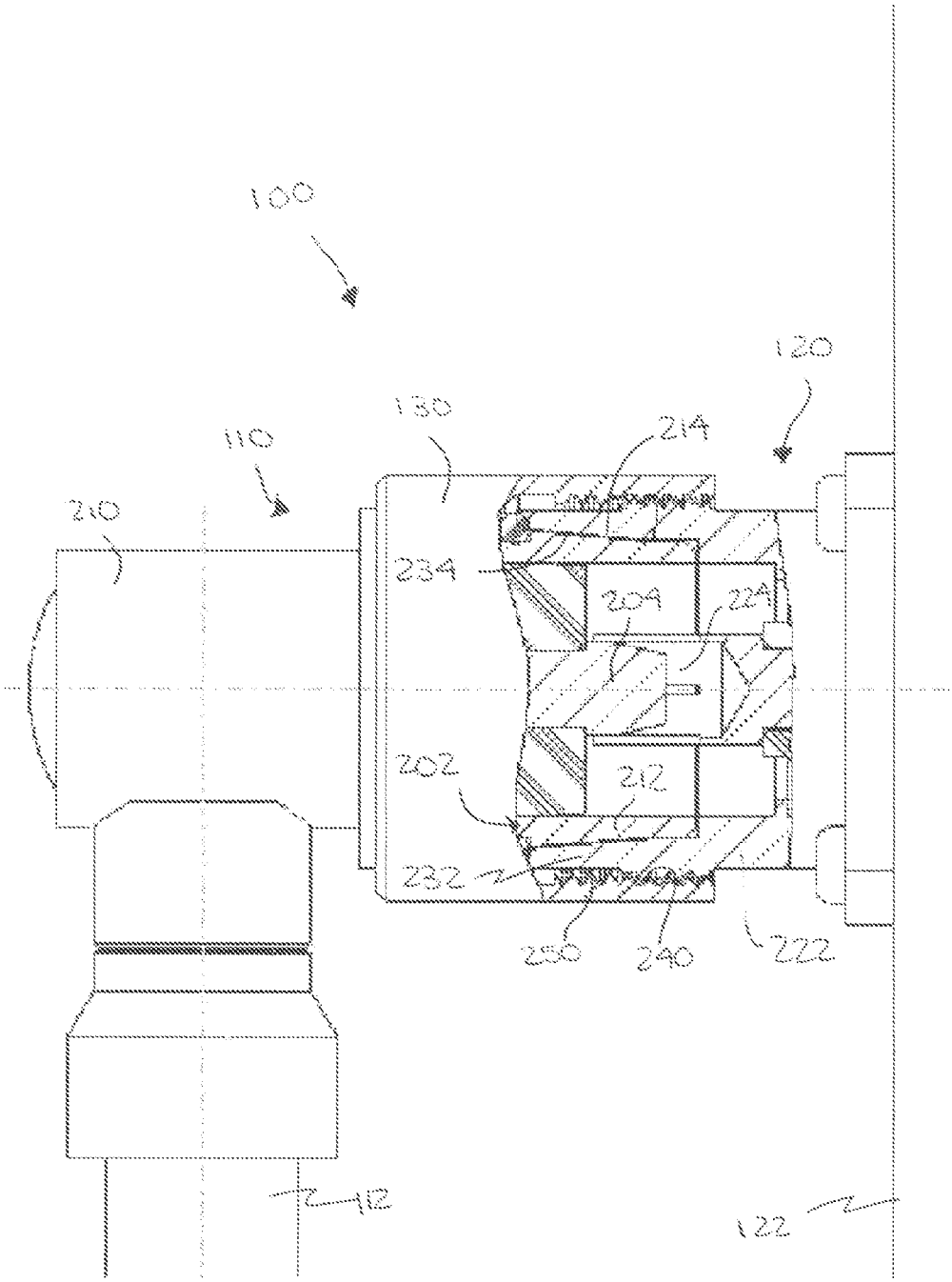
FIG. 3 is an elevational view in partial section of the electrical connector assembly illustrated in FIG. 1, showing the components of the connector assembly in the assembled state.

An annular receiving area 260 is defined between the outer tapered surface 214 of the plug body 202 and the inner surface of the coupling member 130 that is configured to receive the interface end 232 of the receptacle body 222. As seen in FIG. 3, when the plug and receptacle members 110 and 120 are mated, the interface end 232 of the receptacle body 222 is inserted into the annular receiving area 260 (FIG. 2) of the plug body 202 such that the outer tapered surface 214 of the plug body 202 frictionally engages the inner tapered surface 234 of the receptacle body 222. That frictional fit of the tapered surfaces 214 and 234 forms an inner engagement for securing the plug and receptacle members 110 and 120 together.

The engagement member or threads 250 of the coupling member 130 and the engagement member or threads 240 on the outer surface of the receptacle body 222 engage to form an outer engagement between the plug member 110 and the receptacle member 120. Although it is preferable that the engagement members 240 and 250 be a plurality of threads, any known engagement or fastening mechanism may be used, such as a bayonet engagement. The combination of the inner engagement, that is the frictional fit between tapered surfaces 214 and 234, and the outer engagement, that is the threaded engagement between the coupling member 130 and the receptacle body 222, provides a secure engagement between the plug and receptacle member 110 and 120 that prevents loosening of the connection even during movement, such as vibration. That also maintains a positive electrical connection between the male and female contacts 204 and 224 of the plug and receptacle members 110 and 120 even during movement.

Figure 4A:
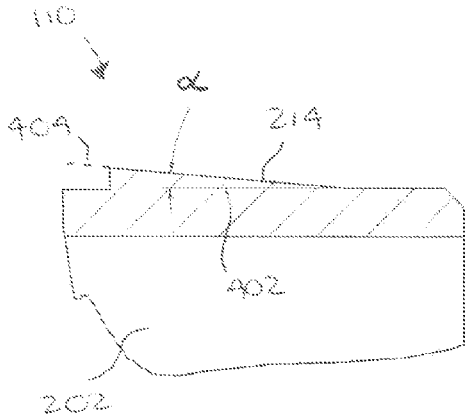
FIGS. 4A and 4B are partial elevational views in section of the interface ends of the components of the electrical connector assembly illustrated in FIG. 1, showing the angle of taper for each interface end.
Figure 4B:
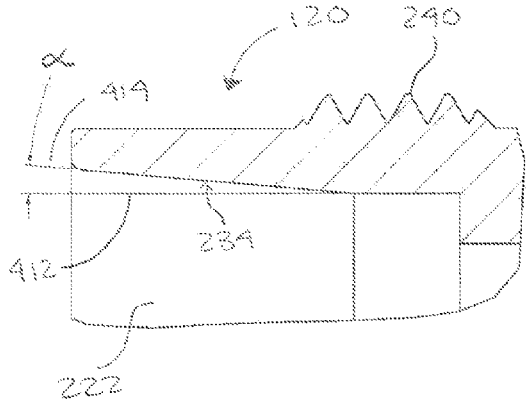

FIGS. 4A and 4B illustrate the preferred angle of taper a of the outer tapered surface 214 (FIG. 4A) of the plug member 110 and the inner tapered surface 234 (FIG. 4B) of the receptacle member 120. As seen in FIG. 4A, the angle of taper a is defined between a longitudinal axis 402 of the plug body 202 and the axis 404 defined by the outer tapered surface 214. As seen in FIG. 4B, the angle of taper a is defined between a longitudinal axis 412 of the receptacle body 222 and the axis 414 defined by the inner tapered surface 234. The angle of taper a is the same for both the outer and inner tapered surfaces 214 and 234 so that a positive friction fit is provided between the plug body 202 and the receptacle body 222. The angle of taper $\alpha$ is selected to provide the appropriate friction fit between the two bodies. That is, if the angle of taper $\alpha$ is too large, the friction fit between the plug and receptacle bodies 202 and 222 would be too loose and would not provide a secure engagement between the two components. On the other hand, if the angle of taper $\alpha$ is too small, the friction fit between the plug and receptacle bodies 202 and 222 would be too strong such that the plug and receptacle members 110 and 120 could not be separated. Testing was conducted on the plug and receptacle members 110 and 120 to determine the preferred angle of taper $\alpha$. Specifically, pull tests were conducted that measure the force necessary to un-mate the plug and receptacle bodies 202 and 222 for various angles of taper $\alpha$. The torque applied during testing included 1 Newton Meter, 1.5 Newton Meter, 2 Newton Meters, and 20 Newton Meters. Based on that testing, it was determined that the preferred angle of taper $\alpha$ is in the range of about 3.5° to 6.5°, and more preferably 5°, which provides a strong enough friction fit between the bodies 202 and 222 without it being overly difficult for the bodies 202 and 222 to be disengaged.

While a particular embodiment has been chosen to illustrate the invention, it will be understood by those skilled in the art that various changes and modifications can be made therein without departing from the scope of the invention as defined in the appended claims. For example, although the plug member 110 is shown as having the male contact and the receptacle member 120 as having the female contact that may be reversed such that the plug member 110 has the female contact and the receptacle member 120 has the male contact. Also, the coupling member 130 may be rotatably mounted to either the plug member 110 or the receptacle member 120, and the corresponding engagement threads may be provided on the outer surface of either the plug or receptacle body 202 and 222, as appropriate. Additionally, although the outer tapered surface 214 is shown as tapering inwardly and the inner tapered surface 234 is shown as tapering outwardly, that may be reversed, as long as the tapered surfaces 214 and 234 provide a frictional fit between the plug and receptacle bodies 202 and 222 when mated.

What is claimed is:

1. An electrical connector assembly, comprising:

a first connector member including a first connector body supporting a pin, said first connector body being formed of a substantially rigid material, said first connector body having a first interface end, said first interface end of said first connector body having a substantially conical shape that defines a first tapered surface;

a second connector member including a second connector body supporting a socket configured to mate with said pin of said first connector member, said second connector body being formed of a substantially rigid material, said second connector body having a second interface end that mates with said first interface end of said first connector member, said second interface end of said second connector member having a second tapered surface, said first and second tapered surfaces having substantially the same angle of taper and taper in opposite directions to engage one another in a friction fit wherein said angle of taper is between about 3.5° to 6.5°, said friction fit forming an inner engagement between said first and second connector members, and said socket receiving said pin at said inner engagement; and a coupling member mounted near one of said first and second interface ends of said first and second connector bodies, respectively, said coupling member having an internal engagement member that is configured to engage a corresponding external engagement member of the other of said first and second connector bodies to form an outer engagement between said first connector member and said second connector member.

2. An electrical connector assembly according to claim 1, wherein said angle of taper of said first and second connector members is 5°.

3. An electrical connector assembly according to claim 1, wherein said first and second connector bodies are formed of a conductive material.

4. An electrical connector assembly according to claim 1, wherein said internal engagement member and said external engagement member are cooperating threads that form said outer engagement between said first and second connector bodies.

5. An electrical connector assembly according to claim 1, wherein an annular receiving area is defined between an inner surface of said coupling member and said first tapered surface of said interface end of said first connector body, said annular receiving area is configured to receive said interface end of said second connector body.

6. An electrical connector assembly according to claim 1, wherein said coupling member is rotatably attached to said one of said first and second connector bodies.

7. An electrical connector assembly according to claim 1, wherein a sealing ring is located adjacent one of said first and second tapered surfaces.

8. An electrical connector assembly according to claim 1, wherein each of said first and second connector bodies includes an insulator that supports said pin and socket, respectively.

9. An electrical connector assembly according to claim 1, wherein one of said first and second tapered surfaces tapers inwardly toward a central longitudinal axis of one said first and second connectors; and the other of said first and second tapered surfaces tapers outwardly away from a central longitudinal axis of the other of said first and second connectors.

10. An electrical connector assembly, comprising:

a plug member including a plug body supporting a male contact, said plug body being formed of a substantially rigid conductive material, said plug body having an interface end and a cable termination end opposite said interface end, said interface end of said plug body having a substantially conical shape that defines a first tapered surface which tapers inwardly toward a central longitudinal axis of said plug body;

a receptacle member including a receptacle body supporting a female contact configured to receive said male contact of said plug member, said receptacle body being formed of a substantially rigid conductive material, said receptacle body having an interface end that mates with said interface end of said plug member and an equipment end opposite said interface end, said interface end of said receptacle body including external threads, said interface end of said receptacle member having a second tapered surface, said second tapered surface tapers outwardly away from a central longitudinal axis of said receptacle body, said first and second tapered surfaces have substantially the same angle of taper and engage one another to form an inner friction fit engagement between said plug member and said receptacle member wherein said angle of taper is between about 3.5° to 6.5°, said friction fit forming an inner engagement between said plug member and said receptacle member, and said female contract receiving said male contact at said inner engagement; and a nut member rotatably mounted to said plug member near said interface end of said plug body, said nut member having internal threads that are configured to engage said external threads of said receptacle body to form an outer threaded engagement between said plug member and said receptacle member.

11. An electrical connector assembly according to claim 10, wherein said angle of taper of said plug and receptacle members is 5°.

12. An electrical connector assembly according to claim 10, wherein said plug body includes an annular groove adjacent said first tapered surface for receiving a sealing ring.

13. An electrical connector assembly according to claim 10, wherein each of said plug and receptacle members includes an insulator that supports said male and female contacts, respectively.

14. An electrical connector assembly according to claim 10, wherein an annular receiving area is defined between an inner surface of said nut member and said first tapered surface of said interface end of said plug body, said annular receiving area is configured to receive said interface end of said receptacle body.

15. An electrical connector assembly according to claim 10, wherein said substantially rigid material of said plug and receptacle bodes is one of a metal or metalized plastic.

16. An electrical connector assembly for mounting to an equipment panel, comprising:

a plug member including a plug body supporting a male contact and a first insulator supporting said male contact, said plug body having an interface end and a cable termination end opposite said interface end, said interface end of said plug body having a first tapered surface which tapers with respect to a central longitudinal axis of said plug body;

a receptacle member including a receptacle body supporting a female contact and a second insulator supporting said female contact, said female contact and said second insulator being separate from said male contact and said first insulator, respectively, said receptacle body having an interface end that mates with said interface end of said plug member and an equipment end opposite said interface end, said interface end of said receptacle body including external threads, said interface end of said receptacle member having a second tapered surface, said second tapered surface tapers with respect to said central longitudinal axis of said receptacle body, wherein said first and second tapered surfaces have substantially the same angle of taper and engage one another to form an inner friction fit engagement between said plug member and said receptacle member, said friction fit forming an inner engagement between said plug member and said receptacle member, and said female contract receiving said male contact at said inner engagement; and a mounting flange disposed on said receptacle member body from said interface end for mounting said receptacle body to the equipment panel; and a nut member rotatably mounted to said plug member near said interface end of said plug body, said nut member having internal threads that are configured to engage said external threads of said receptacle body to form an outer threaded engagement between said plug member and said receptacle member.

* * * * *